United States Patent [19]

Yabuki et al.

[11] Patent Number: 4,744,821

[45] Date of Patent: May 17, 1988

[54] PROCESS FOR PRODUCING SPHEROIDAL METAL PARTICLES

[75] Inventors: Ritsue Yabuki, Iwatsuki; Junya Ohe, Ohmiya, both of Japan

[73] Assignee: Mitsubishi Kinzoku Kabushiki Kaisha, Tokyo, Japan

[21] Appl. No.: 909,117

[22] PCT Filed: Dec. 24, 1984

[86] PCT No.: PCT/JP84/00613

§ 371 Date: Jul. 29, 1986

§ 102(e) Date: Jul. 29, 1986

[87] PCT Pub. No.: WO86/03700

PCT Pub. Date: Jul. 3, 1986

[51] Int. Cl.[4] ..... B22D 23/08

[52] U.S. Cl. ..... 75/0.5 C; 264/13

[58] Field of Search ..... 75/0.5 C; 264/5, 13, 264/14, 15

[56] References Cited

U.S. PATENT DOCUMENTS 2,652,371 9/1953 Gring ..... 264/13
4,124,377 11/1978 Larson ..... 75/0.5 C

FOREIGN PATENT DOCUMENTS 753653 2/1967 Canada .
6470 12/1953 Japan .
3471 2/1969 Japan .
28359 2/1980 Japan .
14083 4/1984 Japan .

*Primary Examiner*—Peter D. Rosenberg
*Attorney, Agent, or Firm*—Frishauf, Holtz, Goodman & Woodward

[57] ABSTRACT

A process for producing metal granules from a molten metal or molten alloy in a refractory vessel by dropping small globules of the melt into a coolant through a small-diameter nozzle provided at the bottom of said refractory vessel is disclosed. The nozzle has one or more vertical holes of an inside diameter of 0.3 to 3.0 mm; the globules of the melt emerging from said nozzle are dropped into a two-layered cooling medium composed of an overlying oil layer having a viscosity grade of 10–680 according to the ISO VG and underlying water layer; said globules are solidified and cooled as they pass through said cooling medium. Spherical metal particles having a uniform size can be produced efficiently in a high yield.

12 Claims, 3 Drawing Sheets

PROCESS FOR PRODUCING SPHEROIDAL METAL PARTICLES

TECHNICAL FIELD

The present invention relates to a process for producing spheroidal metal or alloy particles having a uniform size and shape.

BACKGROUND ART

Spiral bandsaws that cut better and have a longer service life are required in lumbering. In order to meet this demand, several methods have gained commercial acceptance; one method is to braze very hard tips (made of WC-Co sintered alloys) to the saw blade, and in another method, a Co-base hard-facing alloy, typically Stellite No. 1 composed of Co-30 wt % Cr-12 wt % W-2.5 wt % C, is manually padded on the saw blade with oxy-acetylene gas (hereunder referred to as gas padding) and the pad is subsequently hardened.

The ends of exhaust and intake valve stems in gasoline or diesel engines are forced into contact with the rocker arm every time the valves are opened or closed. Therefore, these valve stems are required to have a particularly great wear resistance and are usually gas padded with Stellite No. 1 followed by hardening the pad. Valve stems in small engines are not large enough in diameter to accommodate gas padding, but today, there exists an increasing demand for hardening a face hardening alloy pad that is supplied in small metered amounts.

In continuous casting of copper alloys, active metals are added in the form of a mother alloy. Since the molten metal stays for an extended period within the furnace, the active metal added is oxidized at the surface of the melt to cause variations in the alloy composition. In order to compensate for the loss of active metal due to oxidation, it is necessary to supply the molten metal with a small and metered additional amount of the active metal in a continuous fashion. However, in the present state of the art, such additional active metal is charged intermittently in metered amounts in the form of plates, blocks or shavings.

Welders that enable face-hardening alloys to be padded automatically on the blades of spiral bandsaws have recently been developed for the purpose of automating padding, cutting and finishing operations. Efforts are being made to develop a welder that is capable of automatic padding of intake and exhaust valve stems. Another topic that is under serious consideration is how to automate the addition of active metals in the continuous casting of copper alloys.

Granules and spherical particles that easily roll about themselves are considered to be the best form of the padding alloy or mother alloy fed in automated processes, and the method of feeding rolling granules or spheroidal particles continuously and in metered amounts is gaining increasing acceptance in the industry. Therefore, the current automatic welder for padding a face-hardening alloy is fed with the alloy in granules rather than rods. Furthermore, there is an increasing demand for replenishing a molten copper alloy with spheroidal particles of an active metal having a constant weight.

Therefore, the preparation of spheroidal metal particles having uniformity in size is absolutely necessary for automating the feeding of padding alloys or mother alloys. Various techniques have been proposed and are currently used for making metal particles directly from a melt. However, making spheroidal metal or alloy particles from a melt (hereunder the term "metal particles" will include alloy particles) is very difficult and involves the following problems yet to be solved.

The techniques for making granules directly from a melt are primarily used with low-melting metals such as tin, lead and zinc. In one typical method, a molten metal is poured over a perforated tundish (receptacle having many small holes) and the dripping melt is dropped into water or an oil of low viscosity so as to solidify the melt. However, this method produces either teardrops or unevenly sized globules. In addition, the globules are either deformed or finely dispersed when they drop into water or oil. For these reasons, the method shown above fails to provide a high yield of spherical metal particles having a predetermined size.

A further problem with this method is that it cannot be applied to metals or alloys such as Stellite No. 1 which have high melting points and are very low in ductility since quenched globules will crack due to thermal strain.

SUMMARY OF THE INVENTION

The present inventors have therefore made various studies in order to develop a process for efficient production of uniformly sized spherical metal particles that is applicable to those metals which have high melting points and are not highly amenable to working. Particular emphasis was placed on the need for efficiently producing metal particles directly from a melt. As a result of extensive studies on the constructions of refractory vessels and nozzles, means for melting a metal and dropping the melt, as well as means for solidifying or cooling the globules, the present inventors have arrived at the following observations.

(a) If a molten metal is dripped from a refractory vessel through a nozzle pipe on the bottom having one or more vertical holes of a specified inside diameter, the melt drops in the form of substantially spherical globules rather than teardrops.

(b) Even if the nozzle is brought close to the coolant, the dropping globules unavoidably deform to some extent when they contact the coolant. When the globules are directly dropped into water, which is a common coolant, the globules are cooled so rapidly that they solidify as deformed particles. On the other hand, if the globules are dropped into an oil having a specidifed viscosity, they are cooled slowly and their tendency to contract into a round shape (surface tension) works effectively to correct some degree of the deformation and permits the globules to solidify in the desired spherical form.

(c) If the combination of water and an overlying oil having a specified viscosity is used as a coolant, globules of the molten metal dropping into this two-layered coolant first form spherical shells by the cooling action of the oil; then, the globules reach the water layer where the interior of each globule is completely solidified. Using the two-layered cooling medium has several advantages: first, a shallow cooling vessel may be used; secondly, the number of shrinkage cavities formed is sufficiently reduced to minimize the entrance of water or oil into the metal particles; and thirdly, by recovering through the aqueous layer the metal particles that have partially solidified in the oil layer, the amount of the oil that is carried by the metal particles to the outside of the cooling vessel can be reduced so as to facilitate the subsequent washing step.

The present invention has been accomplished on the basis of these findings. It relates to a process for producing metal granules from a molten metal or a molten alloy having a predetermined composition in a refractory vessel by dropping small globules of the melt into a coolant through a small-diameter nozzle provided at the bottom of said refractory vessel, characterized in that said nozzle has one or more vertical holes of an inside diameter of 0.3 to 3.0 mm, the globules of the melt emerging from said nozzle being dropped into a two-layered cooling medium composed of an overlying oil layer having a viscosity grade of 10–680 according to the ISO VG (International Standards Organization for Viscosity Grading) and an underlying water layer, said globules being solidified and cooled as they pass through said cooling medium. According to the process of the present invention, spherical metal particles having a uniform size can be produced efficiently in a high yield.

PREFERRED EMBODIMENTS OF THE INVENTION

The refractory vessel used in the process of the present invention may be selected from among any of the types of vessel that are capable of holding a molten metal and feeding it to the outside through a basal nozzle. Two typical examples include a tundish designed for simply accommodating and thermally insulating the molten metal; and a crucible furnace that is equipped with an external carbon heating element designed for heat insulation and which is capable of melting the feed metal by RF induction heating.

The vertical holes in the basal nozzle should have an inside diameter of 0.3–3.0 mm. If their inside diameter is less than 0.3 mm, the surface tension of the melt prevents its flowing in a useful quantity even if it is pressurized. On the other hand, if the inside diameter of each hole exceeds 3.0 mm, teardrops or a chain of beads emerges from the nozzle and they remain so even if they are dropped into the oil layer, failing to form spherical granules of a uniform size. In order to obtain the desired spherical metal particles with consistent results, the inside diameter of each hole in the nozzle is preferably adjusted to be within the range of about 0.5 to 2.0 mm. For ensuring efficient operation and maintenance, the use of a replaceable fired nozzle is recommended. The nozzle holes must be vertical in order to obtain granular globules of the melt.

The oil used as a cooling medium in the present invention must have a viscosity grade (ISO VG) of 10 to 680. If the oil used has a viscosity grade of less than 10, the globules of a molten metal pass through the oil layer so rapidly that a thicker oil layer is necessary for enabling the deformed globules to be trimmed to form spherical solidified shells. This necessitates the use of a deeper cooling vessel. If, on the other hand, the viscosity of the oil exceeds ISO VG 680, it is so viscous that is globules cannot be trimmed to spherical particles. In addition, a greater amount of the oil will be carried by the oil into the aqueous layer. Needless to say, a non-fluid oil that confines metal particles is unusable in the present invention.

The use of cooling oils having ISO VG 10–680, preferably 32–460 (corresponding to SAE 10 W–SAE 140), is recommended.

Any of the cooling oils that have viscosities in the ranges specified above will have the ability to solidify the globules of a molten metal into the desired spherical particles. From an operational viewpoint, using lubricants for automotive, marine, industrial or commercial applications that have flash points of 150° C. or higher is preferred. This is in order to prevent the production of a flash from the oil whose surface is close to the refractory vessel containing the molten metal. If oils having lower flash points are used, flashing may be prevented by covering the oil surface with an inert gas or carbon dioxide atmosphere. It should be understood that in order to ensure utmost safety, this technique may also be used with oils having flash points of 150° C. or higher.

The oil layer should have a minimum thickness that enables the globules of molten metal passing through the oil layer to form spherical shells around their surface. Of course, the globules may be completely solidified within the oil layer.

It should also be understood that the ranges specified above for the inside diameter of the vertical nozzle holes and for the viscosity of the cooling oil are not solely applicable to the production of spherical granules of padding alloys for face hardening (e.g. Stellite) or copper mother alloys; the limitations on these parameters are also valid for the purpose of reliable formation of spherical particles from other metals and alloys.

The refractory vessel and the basal nozzle may be made of any refractory material, such as alumina, magnesia and zirconia, that are common in the art of handling molten metals. The particle size of these materials may be properly determined depending upon the type of molten metal and the size of the spherical particles to be obtained.

Figure 1:
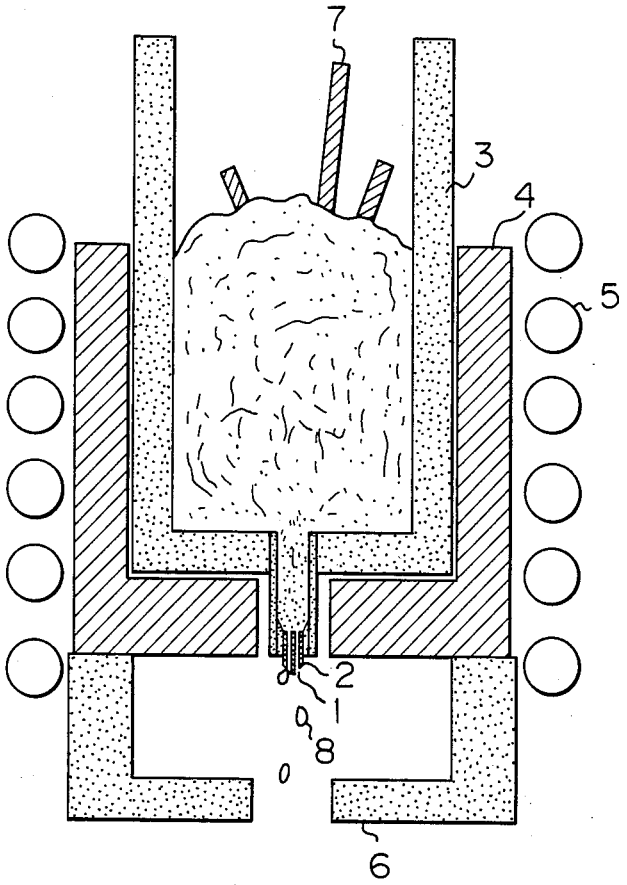
FIG. 1 is a side elevational view of one embodiment of the molten metal dropping apparatus (refractory vessel) used in the process of the present invention.

The refractory vessel shown in FIG. 1 consists of an alumina crucible 3 having a basal nozzle 2 with two vertical holes 1. The crucible 2 is surrounded by a carbon heating element 4 which is placed within an RF induction heating coil unit 5. The apparatus shown in FIG. 1 also includes an alumina refractory 6 that not only holds the heating element 4 and heating coil 5 in position but also insulates the heat of radiation from the element 4.

The process of the present invention proceeds as follows. Rods of feed alloy 7 that have been prepared by melting techniques to have the desired composition are charged into the crucible 3, which is heated by the RF induction coil 5 to melt the rods. The resulting melt emerges from the lower end of the nozzle 2 and drops into the cooling medium as globules 8.

Figure 2:
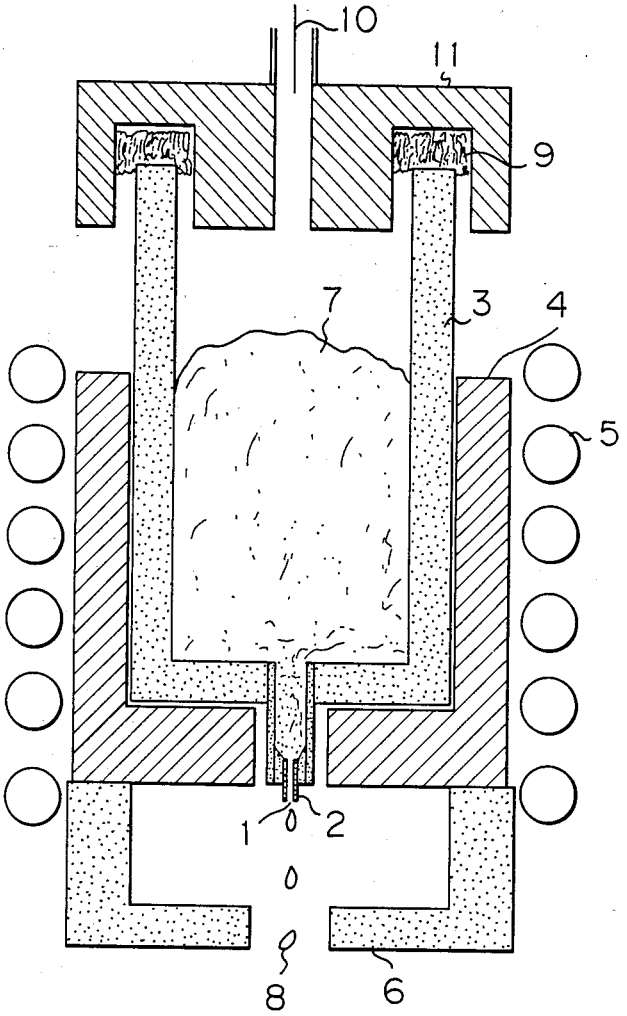
FIG. 2 is a side elevational view of another embodiment of the molten metal dropping apparatus.

The concept shown in FIG. 2 is used with a basal nozzle having a very small vertical hole. The principal components of the apparatus in FIG. 2 are the same as those shown in FIG. 1 and like components are identified by like numerals. In FIG. 2, the open end of the crucible 3 is closed with a cover 11 having an inlet 10 for introducing an inert gas (including reducing gas). A refractory wool layer 9 is disposed between the top of the crucible and the cover 11 in order to prevent any leakage of an inert gas (including a reducing gas) that has been fed into the crucible. By pressurizing the molten feed alloy 7 with the introduced inert gas, globules of the melt can freely pass through the small hole for dropping into the cooling medium.

EXAMPLE

The advantages of the present invention are shown below in comparison with prior art techniques.

Round bars (4.8 mm[100]) were prepared from each of the commercial face-hardening alloys A and B. Rectangular bars (15 mm×10 mm) of conditioning base alloy C were also prepared. For the compositions of the three alloys, see Table 1. One kilogram of each alloy was melted in an apparatus of the type shown in FIG. 3 and dropped into a cooling medium to prepare spherical alloy particles.

Figure 3:
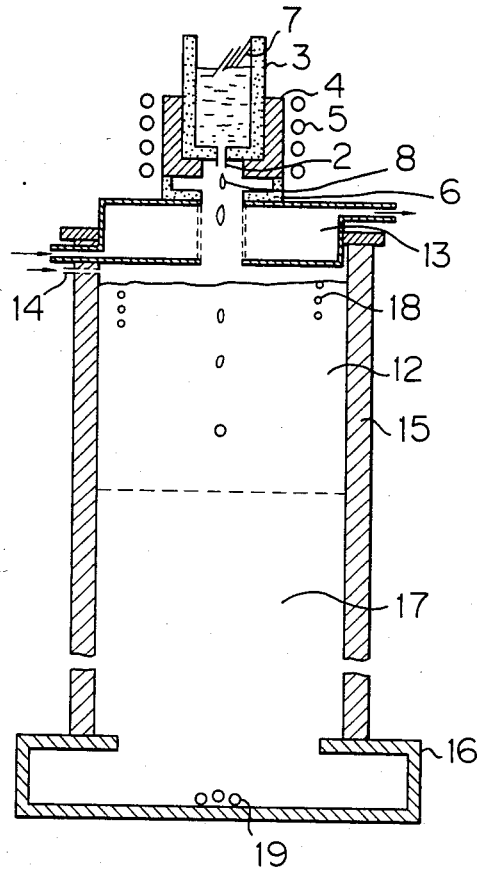
FIG. 3 is a side elevational view of the apparatus used in the Example (to be shown hereunder) for producing spheroidal metal particles.

The apparatus in FIG. 3 was identical to the type shown in FIG. 1 except that the basal nozzle extending from the refractory vessel had a single vertical hole. In FIGS. 1 and 3, like numerals identify like components.

The data in Table 2 show that the process of the present invention is capable of providing virtually spheroidal alloy particles having a very narrow weight distribution. Table 2 also shows the relationship between the diameter of the nozzle hole and the weight distribution of the spherical particles obtained.

Alloy particles were prepared from alloy A by changing the diameter of the nozzle hole as follows: 0.1 mm, 0.3 mm, 0.5 mm, 0.6 mm, 0.7 mm, 0.8 mm, 1.0 mm, 1.5 mm, 2.0 mm, 3.0 mm and 4.0 mm. The results are shown in Table 3, from which one can see that no molten metal flowed through the nozzle having a nozzle hole diameter of 0.1 mm even when the container was pressurized with argon gas. With the nozzle hole having a diameter of 4.0 mm, the molten metal just flowed out of the crucible in a continuous manner and the resulting particles were in the form of chained beads or teardrops. As a further problem, the temperature of the lubricant increased so as to reduce its viscosity and thereby created the risk of producing a flash.

It is therefore concluded that the inside diameter of the holes in the nozzle used in the present invention must be in the range of from 0.3 to 3.0 mm.

TABLE 1

| Alloy type | Chemical composition (wt %) | | | | | | | | | |
|---|---|---|---|---|---|---|---|---|---|---|
| | C | Cr | Fe | W | Si | B | Co + impurities | Ni + impurities | Cu + impurities | Remarks |
| A | 2.51 | 30.04 | — | 12.01 | 1.02 | — | bal. | — | — | Co—W alloy |
| B | 0.76 | 15.02 | 4.15 | — | 4.05 | 3.48 | — | bal. | — | Ni—B alloy |
| C | — | — | — | — | — | 1.76 | — | — | bal. | Cu—B alloy |

TABLE 2

| Alloy type | Average weight (mg) | Weight distribution (No. of granules) | | | | | | |
|---|---|---|---|---|---|---|---|---|
| | | 154–182 mg | 183–242 mg | 243–285 mg | 286–328 mg | 360–504 mg | 505–540 mg | 541–567 mg |
| A | 212.4 | 2 | 92 | 6 | 0 | — | — | — |
| B | 251.6 | 1 | 22 | 70 | 7 | — | — | — |
| C | 501.7 | — | — | — | — | 13 | 73 | 14 |

The globule dropping and solidifying section of the apparatus in FIG. 3 had the following construction. Below the alumina refractory 6 was provided a heat insulating tank 13 filled with water to prevent the increase in the temperature of cooling oil 12 due to the heat of radiation from the heating element 4. The tank 13 had an inlet 14 through which an inert gas could be introduced for preventing the production of a flash from the cooling oil 12.

The water tank 13 was connected to a cooling tube 15 and a spheriodal metal particle receptacle 16. The cooling tube 15 contained cooling oil 12 and cooling water 17 in two layers. A cooling spiral coil 18 was placed within the cooling oil 12 to inhibit the increase in its temperature. Spheroidal metal particles produced in the apparatus in FIG. 3 are indicated at 19.

Nozzle holes having diameters of 0.6 mm, 0.7 mm and 1.5 mm were used for treating alloys A, B and C, respectively. Cooling oils used for the respective alloys were lubricants having the following viscosity grades: alloy A. . . ISO VG 32, alloy B . . . ISO VG 220, and alloy C . . . ISO VG 460.

Spheroidal alloy particles were prepared by dropping the melt through the nozzle and solidifying and cooling the globules by passage through the lubricant and water layers. A hundred samples were randomly taken from each population and checked for their average weight and weight distribution. The results are shown in Table 2.

TABLE 3

| | Inside diameter of vertical nozzle hole (mm) | | | | | |
|---|---|---|---|---|---|---|
| | 0.1 | 0.3 | 0.7 | 1.5 | 3.0 | 4.0 |
| Melt dropping | Not dropped (super-atmospheric) | Good (super-atmospheric) | Good | Good | Good | teardrops flowed continuously |
| Average weight (mg) | — | 142 | 201 | 368 | 526 | — |
| Weight distribution | — | Good | Good | Good | Good | — |

Industrial Applications

As will be apparent from the foregoing description, the present invention provides a relatively simple process for producing spheroidal metal particles of the desired size in a high yield. The invention will prove useful in industry since it enables the efficient production of spheroidal metal particles such as shots for automatic padding onto the blades of spiral bandsaws, shots for automatic padding onto the ends of intake or exhaust valve stems, or shots for automatic addition of active metals in the form of a mother alloy during the continuous casting of copper alloys.

We claim:

1. A process for producing spheroidal metal granules for use in pad hardening having substantially uniform size and shape from a melt of a molten metal from the group consisting of nickel, cobalt or copper or a molten alloy from the group consisting of nickel-base, cobalt-base and copper-base alloys, said melt being held in a refractory vessel having a small-diameter nozzle provided at the bottom thereof by dropping small globules of said melt into a coolant through said nozzle, said nozzle having one or more vertical holes of an inside diameter of 0.3 to 3.0 mm, the globules of the melt emerging from said nozzle being dropped into a two-layered cooling medium composed of an overlying oil layer having a viscosity grade of 10–680 according to the ISO VG (International Standards Organization for Viscosity Grading) and an underlying water layer, said globules being solidified and cooled as they pass through said cooling medium.

2. A process for producing metal granules for use in pad hardening according to claim 1 wherein the inside diameter of said vertical hole is in the range of 0.5 to 2.0 mm.

3. A process for producing metal granules for use in pad hardening according to claim 1 wherein the viscosity grade of said overlying oil layer is in the range of ISO VG 32–460.

4. A process in accordance with claim 1 wherein said melt is made of a cobalt-base hard-facing alloy.

5. A process in accordance with claim 1 wherein said melt is made of a nickel-chromium-silicon-boron alloy.

6. A process in accordance with claim 1 wherein said melt is made of a copper-boron alloy.

7. A process in accordance with claim 1 wherein an atmosphere of inert gas is maintained in said refractory vessel above said melt.

8. A process in accordance with claim 1 wherein an inert gas atmosphere is maintained above said cooling oil layer.

9. A process in accordance with claim 1 wherein said cooling oil has a flash point of at least about 150? C.

10. A process for producing Co-base alloy granules having a uniform size and shape for use in pad hardening from a molten Co-base alloy in a refractory vessel by dropping small globules of the melt into a coolant through a small-diameter nozzle provided at the bottom of said refractory vessel, wherein said nozzle has a vertical hole of an inside diameter of 0.3 to 3.0 mm, the globules of the melt emerging from said nozzle under pressure being dropped into a two-layered cooling medium composed of an overlying oil layer having a viscosity grade of 10–680 according to the ISO VG (International Standards Organization for Viscosity Grading) and an underlying water layer, said globules being solidified and cooled as they pass through said cooling medium.

11. A process for producing Co-base alloy granules for use in pad hardening according to claim 1 wherein the inside diameter of said vertical hole is in the range of 0.5 to 2.0 mm.

12. A process for producing Co-base alloy granules for use in pad hardening according to claim 1 wherein the viscosity grade of said overlying oil layer is in the range of ISO VG 32–460.

* * * * *